United States Patent [19]

Bradley et al.

[11] Patent Number: 4,763,785

[45] Date of Patent: Aug. 16, 1988

[54] CENTER-PULL FIBER PACKAGE AND METHOD FOR PRODUCING THE PACKAGE

[75] Inventors: William A. Bradley; Pat J. Carbone; Howell L. Peterson, all of Charlotte, N.C.

[73] Assignee: BASF Aktiengesellschaft, Ludwigshafen, Fed. Rep. of Germany

[21] Appl. No.: 106,528

[22] Filed: Oct. 9, 1987

[51] Int. Cl.[4] ..... B65D 85/02

[52] U.S. Cl. ..... 206/389; 242/159; 242/178

[58] Field of Search ..... 242/178, 176, 174, 159, 242/222; 206/389, 392

[56] References Cited

U.S. PATENT DOCUMENTS

| | | | |
|---|---|---|---|
| 3,552,679 | 1/1971 | Rollason et al. | 242/159 |
| 4,460,086 | 7/1984 | Davis | 206/389 |
| 4,544,113 | 10/1985 | Yoshinaga et al. | 242/178 |
| 4,673,140 | 6/1987 | Boles | 242/159 |

*Primary Examiner*—William Price

*Attorney, Agent, or Firm*—Burns, Doane, Swecker & Mathis

[57] ABSTRACT

A center-pull fiber package is provided in which a fibrous material may be wound onto a core structure comprising a core element and an overwrap release paper. Upon removal of the center elements, an end of the fibrous material is exposed so that the package may be unwound by removing a predetermined length of the winding from the interior or center of the package.

29 Claims, 1 Drawing Sheet

CENTER-PULL FIBER PACKAGE AND METHOD FOR PRODUCING THE PACKAGE

BACKGROUND OF THE INVENTION

Center-pull packages are packages which permit yarn, fibers or any material which has been coiled or wound for delivery, to be removed from an interior region of the package rather from the outside or exterior of the package. A bobbin or spool is provided on which the material has been wound.

Center-pull packages of the foregoing type have been used for some time in the textile and fiberglass industries as they provide a substantially free and unrestricted delivery for unwinding the fiber over an extremely wide speed range from a stationary or non-rotating package. By providing the package as a non-rotating fiber dispensing package, it is not necessary to provide the machinery on which a bobbin or spool would otherwise be placed so as to rotate the bobbin or spool and permit the package material to be unwound. Center-pull packages are typically produced on special winding equipment having a collapsible mandrel which can contract after the package has been wound and permit the finished package to be slipped off the mandrel, thereby exposing the inner surface of the cylinder package for withdrawal of the fiber. In order to support the center-pull packages of the prior art, special packing techniques have sometimes been required to support and protect these packages while they are in transit from manufacturer to user.

An example of a center-pull package is disclosed by U.S. Pat. No. 2,596,970 which discloses a packaging technique for a coil of wire or cable. Therein, the wire is wound upon a mandrel which has a tubular leather sleeve placed around the mandrel prior to winding the wire on the mandrel. The wire or cable is wound on the mandrel until the coil of wire or cable reaches any predetermined outside diameter. After the predetermined outside diameter is obtained, the coil of wire or cable is then removed from the mandrel and a central pay out opening permits the wire to be withdrawn therethrough. U.S. Pat. No. 533,688 is also representative of the prior art in which a roll of material is wound onto a driven spindle. After the roll of material has reached a predetermined size, it is then removed from the driven spindle.

U.S. Pat. Nos. 3,732,974 and 3,785,483 are also examples of packages for the handling and transportation of fibers. Both patents disclose the use of packages in which the fiber material is discharged from the external winding portion.

SUMMARY OF THE INVENTION

The present invention provides a method by which a package of fibrous material can be produced which utilizes center-pull unwinding and which permits the use of standard winding equipment. The packages produced by the present arrangement can be shipped by using standard packing methods. In use, the package and method includes a core or tube (e.g., a cylindrical cardboard core) which is used as a support for the packages. The cardboard core or tube is overwrapped with a paper or paper-like sheet which is treated on one side with a release agent. The paper sheet is applied to the cardboard core so that the side of the paper which has been treated with the release agent is adjacent the cardboard core or tube so that the nontreated surface of the paper is exposed to the fiber which will be wound thereon and prevent slippage of the fiber with respect to the sheet. Subsequent to the winding and removal of the package from the winder, the cardboard core can then be slidingly removed from the package due to the presence of the release agent on the paper sheet. The paper sheet which overwrapped the cardboard can then be collapsed and removed from the interior of the package. Upon the removal of the paper sheet overwrap, the interior of the fiber package is exposed and the end of the fibrous material which was first applied to the overwrapped paper sheet can be exposed so that the fiber can then be withdrawn from the inside or interior of the package as needed.

The cardboard core can be left in place for shipment and other handling of the package and all known packing materials may also be used to support and protect the package during shipping.

The package is suitable for receiving various types of fibrous materials. The fibrous material may be composed of inorganic or organic fibrous materials and may be formed by conventional techniques which will be apparent to those skilled in the art. The fibers are commonly formed from fibrous materials utilized in the formation of fiber reinforced composites. For instance, the fibrous material may be a carbonaceous fibrous material which contains at least about 90 percent carbon by weight (preferably at least about 95 percent carbon by weight in some embodiments). The carbon of such carbonaceous fibrous materials may be primarily amorphous in nature or exhibit a graphitic carbon x-ray diffraction pattern. A preferred inorganic fibrous material is a carbonaceous fibrous material which contains at least about 95 percent carbon by weight and exhibits a predominantly graphitic x-ray diffraction pattern. Other representative inorganic fibrous materials are those formed from glass fiber, boron carbide fiber, silicon carbide fiber, aluminum silicate fiber, and metallic fiber (e.g. stainless steel fiber). Representative organic fibrous materials are the polymeric fibrous materials, such as those of acrylic polymers, polyolefins, polyesters, polyamides, polybenzimidazoles, cellulosics, etc., and mixtures of these.

The fibrous material could be a monofilament or be multifilamentary in nature. Multifilamentary fibrous materials can be formed of continuous or discontinuous fibers. In a preferred embodiment the fibrous material consists of a plurality of substantially parallel continuous filaments which optionally may be twisted together to form a fiber bundle. For instance, a preferred carbonaceous fibrous material could consist of approximately 3,000, 6,000 or 12,000 substantially continuous carbon filaments available from the Celion Carbon Fibers Division of BASF Structural Materials, Inc. of Charlotte, N.C. U.S.A.

DESCRIPTION OF A PREFERRED EMBODIMENT

Figure 1:
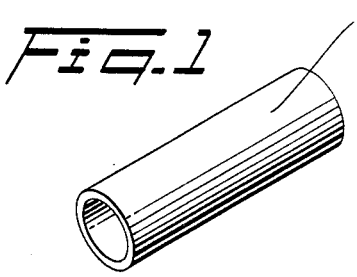
FIG. 1 is a perspective view of a cylindrical cardboard core in the package of the present invention.
Figure 2:
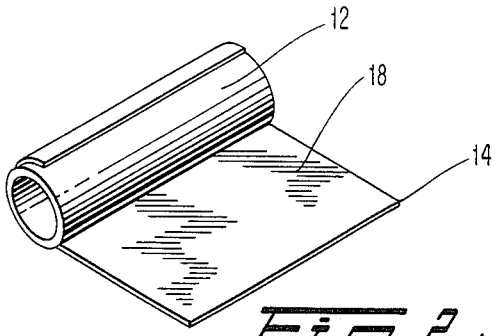
FIG. 2 is a perspective view showing a partially completed step in forming the package of the present invention.
Figure 3:
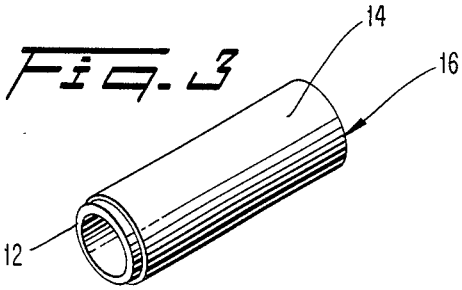
FIG. 3 is a perspective view showing a completed step in the process of forming the package of the present invention.
Figure 4:
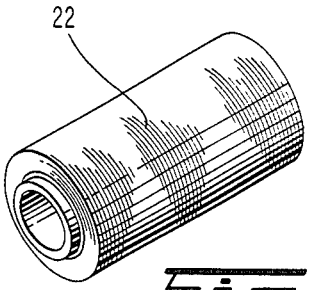
FIG. 4 is a carbon fiber package formed according to the present invention.

FIG. 1 discloses a core element 12 which may be formed of cardboard or other suitable materials and is substantially in the form of a right circular cylinder. The core element 12 is the support on which the fiber package of the present invention is formed. Accordingly, the core element should be sturdy enough to prevent collapse of the package during winding operations and sturdy enough to provide interior support during shipment of the finished fiber package. The cardboard element 12 is overwrapped with a release paper sheet 14 as shown in FIG. 2. The release paper 14 is wrapped around the cardboard core element 12 so as to provide a concentric tube arrangement 16 as shown in FIG. 3. The release paper sheet 14 is provided with a silicone treated surface 18. The core element 12 is overwrapped with the release paper sheet 14 so that the silicone treated surface 18 is adjacent the core element 12.

Figure 8:
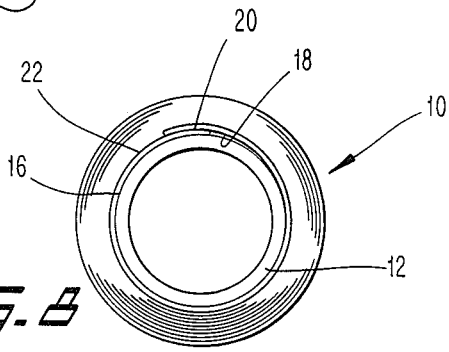
FIG. 8 is an end view of the package of FIG. 4.

As more clearly shown in FIG. 8, the concentric relationship of the core element 12 and the paper sheet 14 provides for the silicone coated or treated surface 18 to be adjacent the cardboard core 12 with the release paper 14 overlapping at a junction 20. The overlap 20 is provided so that the silicone treated release paper will be prevented from unwrapping during fiber windup by the winding equipment. The overlap 20 will prevent unwrapping as the overlap 20 extends in a direction opposite to the direction that the core element 12 rotates during the process of winding the fiber to form the package. This direction of wrapping permits the fiber to be wound onto the core 12 in the direction which would permit unwrapping of the paper sheet 14.

The continuous length of multifilamentary fibrous material 22 is then wound on the release paper 14 on a side of the release paper 22A which has not been treated or coated with silicone. Subsequent to the winding of the fibrous material 22 on the core element and release paper, the fiber package is then made ready for use by removal of the core element 12 and release paper 14.

Figure 5:
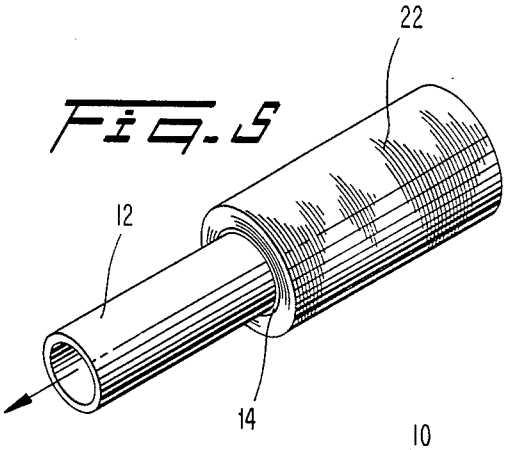
FIG. 5 is a further step in the process of providing a center-pull package in accordance with the present invention.
Figure 6:
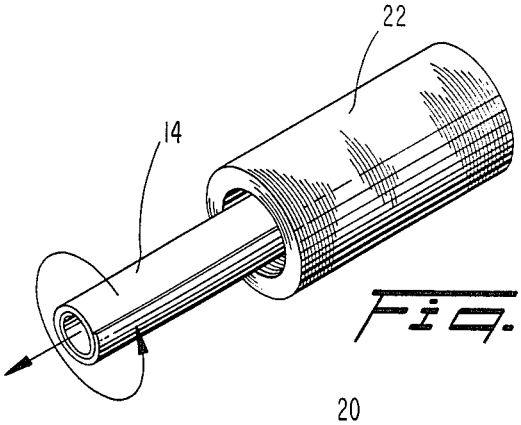
FIG. 6 is a further step in the process of providing and using a center-pull package according to the present invention.
Figure 7:
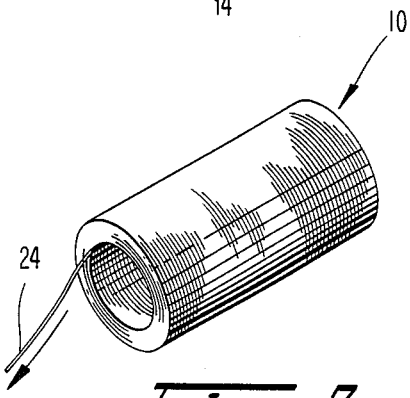
FIG. 7 is a completed package produced by the present invention with the cylindrical cardboard core and an overwrap removed so as to show the center-pull arrangement.

As shown in FIG. 5, the core element 12 may be grasped by any suitable means, e.g., a pair of pliers, and removed from the fiber package. Upon removal therefrom, the release paper 14 may then be removed, as shown in FIG. 6, by collapsing the paper on itself or by straight removal from the interior of the wound fiber package. As shown in FIG. 7, the fiber package 10 is then ready for use as the first end of fibrous material 24, applied to the release paper 14, is then exposed and removed from the center or interior of the fiber package thereby providing a fiber package which permits the fibrous material to be unwound with ease from the center or interior of the package.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. As an example, multiple packages can be connected together to provide for unwinding of several packages, each consisting of predetermined lengths of fibrous material wound thereon. Accordingly, the foregoing detailed description should be considered exemplary in nature and not limited to the scope and spirit of the invention as set forth in the appended claims.

What is claimed is:

1. Method for producing a center-pull package comprising the steps of:
   - wrapping a core cylinder with a material release segment;
   - overlapping a first end of the segment with a second end of the segment;
   - winding a fibrous material around said segment;
   - removing the core cylinder from the package; and
   - removing the release material segment from the package so as to permit removal of the fibrous material starting from the interior of the package.

2. The method of claim 1, wherein said material release segment is silicone coated.

3. The method of claim 2, wherein only one side of said material release segment is silicone coated.

4. The method of claim 2, further comprising:
   - positioning said material release segment during said wrapping step so that the silicone coating present thereon is in contact with said core cylinder.

5. The method of claim 1, wherein said fibrous material is an inorganic fibrous material.

6. The method of claim 1, wherein said fibrous material is a carbonaceous fibrous material which contains at least 90 percent carbon by weight.

7. The method of claim 6, wherein the carbon of said carbonaceous fibrous material is primarily amorphous in nature.

8. The method of claim 6, wherein the carbon of said carbonaceous fibrous material includes graphitic carbon.

9. The method of claim 1, wherein said fibrous material is an organic polymeric fibrous material.

10. The method of claim 9, wherein the organic polymeric fibrous material is selected from the group consisting of acrylic polymers, polyolefins, polyesters, polyamides, polybenzimidazoles, and cellulosics.

11. A center-pull package for dispensing a continuous length of a fibrous material comprising a core cylinder, a material release segment, and a winding of said fibrous material, said material release segment being wrapped around said core cylinder with a first end of said segment overlying a second end of said segment, and said winding of said fibrous material being applied around said material release segment.

12. The center-pull package of claim 11, wherein one side of said material release segment has a silicone coating.

13. The center-pull package of claim 12, wherein the silicone coated side is in contact with said core cylinder when said material release segment is wrapped around said core cylinder.

14. The center-pull package of claim 11, wherein said fibrous material is an inorganic fibrous material.

15. The center-pull fiber package of claim 11, wherein said fibrous material is a carbonaceous fibrous material which contains at least 90 percent carbon by weight.

16. The center-pull package of claim 14, wherein the carbon of said carbonaceous fibrous material is primarily amorphous in nature.

17. The center-pull fiber package of claim 14, wherein said carbon of said carbonaceous fibrous material includes graphitic carbon.

18. The center-pull package of claim 11, wherein said fibrous material is an organic polymeric fibrous material.

19. The center-pull package of claim 18 wherein the organic polymeric fibrous material is selected from the group consisting of acrylic polymers, polyolefins, polyesters, polyamides, polybenzimidazoles, and cellulosics.

20. A center-pull package for dispensing a continuous length of a fibrous material comprising a core cylinder, a material release segment, and a predetermined length of said fibrous material wound in a plurality of overlying wraps around said material release segment, said predetermined length defined by a first end and a second end, said package produced by a process including:

wrapping said core cylinder with said material release segment so that one end of said material release segment overlaps an opposite end of said material release segment;

winding said predetermined length of fibrous material around said material release segment starting with said first end;

removing the core cylinder from said package; and removing the material release segment from said package so as to permit removal of the fibrous material starting with said first end.

21. The center-pull package of claim 20, wherein said material release segment is silicone coated.

22. The center-pull package of claim 21, wherein only one side of said material release segment is silicone coated.

23. The center-pull package of claim 22, wherein during said wrapping step said material release segment is positioned so that the silicone coating present thereon is in contact with said core cylinder.

24. The center-pull package of claim 20, wherein said fibrous material is an inorganic fibrous material.

25. The center-pull package of claim 20, wherein said fibrous material is a carbonaceous fibrous material which contains at least 90 percent carbon by weight.

26. The center-pull package of claim 25, wherein the carbon of said carbonaceous fibrous material is primarily amorphous in nature.

27. The center-pull package of claim 25, wherein the carbon of carbonaceous fibrous material includes graphitic carbon.

28. The center-pull package of claim 20, wherein said fibrous material is an organic polymeric fibrous material.

29. The center-pull package of claim 28, wherein said organic polymeric fibrous material is selected from the group consisting of acrylic polymers, polyolefins, polyesters, polyamides, polybenzimidazoles, and cellulosics.

* * * * *